US011454432B2

(12) United States Patent
Muller

(10) Patent No.: US 11,454,432 B2
(45) Date of Patent: Sep. 27, 2022

(54) REFRIGERATION APPARATUS WITH REFRIGERANT LUBRICANT SUBCOOLING HEAT EXCHANGER AND USE THEREOF

(71) Applicant: Carrier Corporation, Palm Beach Gardens, FL (US)

(72) Inventor: Raphael Muller, Lyons (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 122 days.

(21) Appl. No.: 16/876,815

(22) Filed: May 18, 2020

(65) Prior Publication Data

US 2020/0370799 A1 Nov. 26, 2020

(30) Foreign Application Priority Data

May 21, 2019 (EP) ..... 19175790

(51) Int. Cl.
*F25B 31/00* (2006.01)
*F25B 40/02* (2006.01)
*F28D 1/04* (2006.01)

(52) U.S. Cl.
CPC ..... *F25B 31/002* (2013.01); *F25B 40/02* (2013.01); *F28D 1/0461* (2013.01); *F25B 2400/054* (2013.01); *F25B 2500/16* (2013.01)

(58) Field of Classification Search
CPC .... F25B 31/002; F25B 40/02; F25B 2500/16; F25B 31/006; F25B 2400/0409;
(Continued)

(56) References Cited

U.S. PATENT DOCUMENTS 5,881,564 A 3/1999 Kishimoto et al.
6,176,092 B1 * 1/2001 Butterworth ..... F04D 29/023 62/193

(Continued)

FOREIGN PATENT DOCUMENTS

DE 102006032570 * 2/2008 ..... F28D 1/0461
EP 1400765 A2 3/2004

OTHER PUBLICATIONS

European Search Report for application EP 19175790.5, dated Aug. 21, 2019, 5 pages.

*Primary Examiner* — Jerry-Daryl Fletcher
*Assistant Examiner* — Daniel C Comings
(74) *Attorney, Agent, or Firm* — Cantor Colburn LLP

(57) ABSTRACT

A refrigeration apparatus, including a main circuit for a loop circulation of a main flow of refrigerant, the main circuit including a compressor, a condenser, an expansion valve and an evaporator. The refrigeration apparatus comprises a lubrication branch, for deriving a lubrication flow from the main flow for feeding the compressor for lubrication. The main circuit includes a low-temperature part, consisting in the evaporator, the compressor inlet, and any part of the main circuit between the evaporator and the compressor inlet. The lubrication branch further includes a subcooling heat exchanger, which is configured for enabling an exchange of heat between the lubrication flow circulating through the lubrication branch and the main flow of refrigerant circulating through the low-temperature part, so that the lubrication flow may be cooled by the main flow of refrigerant circulating through the low-temperature part, within the subcooling heat exchanger.

14 Claims, 4 Drawing Sheets

(58) Field of Classification Search
CPC ..... F25B 2400/05; F25B 2400/054; F28D 1/0461; F28D 7/0066
See application file for complete search history.

(56) References Cited

U.S. PATENT DOCUMENTS

| | | | | |
|---|---|---|---|---|
| 7,073,347 | B2 * | 7/2006 | Hermes | F25B 39/02 62/515 |
| 2006/0117790 | A1 * | 6/2006 | Dieterich | F04C 29/021 62/467 |
| 2008/0245082 | A1 * | 10/2008 | Sishtla | F16C 39/02 62/84 |
| 2010/0132927 | A1 * | 6/2010 | Benetton | F25B 39/02 165/158 |
| 2016/0047575 | A1 | 2/2016 | Jonsson et al. | |

* cited by examiner

REFRIGERATION APPARATUS WITH REFRIGERANT LUBRICANT SUBCOOLING HEAT EXCHANGER AND USE THEREOF

FOREIGN PRIORITY

This application claims priority to European Patent Application No. 19175790.5, filed May 21, 2019, and all the benefits accruing therefrom under 35 U.S.C. § 119, the contents of which in its entirety are herein incorporated by reference.

BACKGROUND

The present invention concerns a refrigeration apparatus and the use of said refrigeration apparatus.

The invention relates to the domain of machines that implement a thermodynamic cycle to a refrigerant, for producing a refrigeration effect.

A refrigerating apparatus is known from EP 1 400 765 A2, comprising a refrigerant passage including a screw compressor, a condenser, an expansion valve and an evaporator. This known apparatus comprises a bypass flow passage, branching at a part of said refrigerant passage, between the condenser and the expansion valve, routing the refrigerant through throttle means, and communicating with a rotor cavity of the screw compressor. Lubrication of the rotor cavity is achieved by the same fluid that is also used as the refrigerant in the passage, and in the absence of oil.

For successfully lubricating the rotor cavity, one must ensure that a significant part of the refrigerant reaching the rotor cavity is in a liquid state. This is usually the case when the refrigerating apparatus is operating at high load, corresponding in particular to a high flow of refrigerant. When the refrigerating apparatus is operating at full load, the refrigerant emitted by the condenser is generally entirely in a liquid state, or in a diphasic state with little proportion of the refrigerant in gaseous state.

However, if the need for refrigeration is lower, the apparatus may be operating at low load, including in particular a smaller flow of refrigerant. During low load operation of the apparatus, it may happen that the refrigerant circulating through the bypass flow passage is not entirely in liquid state and contains a non-negligible proportion of refrigerant in gaseous state, or even a high proportion of refrigerant in gaseous state. Since refrigerant in a gaseous state is not able to sufficiently lubricate the compressor, there is a risk of damaging or destroying the compressor due to a lack of lubrication during low load operation of the apparatus.

SUMMARY

An aim of the invention is to provide a refrigeration apparatus where satisfactory lubrication of the compressor by means the refrigerant is obtained even during low load operation of the refrigeration apparatus.

An object of the invention is a refrigeration apparatus, comprising a main circuit, including: a compressor, including a compressor inlet and a compressor outlet, a condenser, including a condenser inlet, connected to the compressor outlet, and a condenser outlet, an expansion valve, including a valve inlet, connected to the condenser outlet and a valve outlet, and an evaporator, including an evaporator inlet, connected to the valve outlet, and an evaporator outlet, connected to the compressor inlet.

According to the invention, the main circuit is configured for a loop circulation of a main flow of refrigerant, successively through the compressor, the condenser, the expansion valve, and the evaporator.

According to the invention, the refrigeration apparatus further comprises a lubrication branch, comprising: a lubrication inlet, connected to a supply part of the main circuit, the supply part consisting in the condenser, the valve inlet, and any part of the main circuit between the condenser outlet and the valve inlet, the lubrication inlet being configured to derive a lubrication flow from the main flow of refrigerant circulating through the supply part; and a lubrication outlet, connected to the compressor so as to feed the compressor with the lubrication flow, for lubrication of said compressor with the refrigerant of the lubrication flow.

According to the invention, the main circuit comprises a low-temperature part, consisting in the evaporator, the compressor inlet, and any part of the main circuit between the evaporator outlet and the compressor inlet.

According to the invention, the lubrication branch further comprises a subcooling heat exchanger, which is configured for enabling an exchange of heat between the lubrication flow circulating through the lubrication branch and the main flow of refrigerant circulating through the low-temperature part, so that the lubrication flow may be cooled by the main flow of refrigerant circulating through the low-temperature part, within the subcooling heat exchanger.

Thanks to the invention, the lubrication flow of refrigerant, used for lubricating the compressor, is cooled through the subcooling heat exchanger by the main flow of refrigerant circulating through the evaporator prior to introduction of the lubrication flow into the compressor. Thus, the subcooling heat exchanger ensures that the lubrication flow of the refrigerant is in liquid form or ensures that the lubrication flow contains enough refrigerant in liquid form for achieving sufficient lubrication of the compressor. The main flow of refrigerant circulating through the evaporator is a stage of the thermodynamic cycle of the refrigeration apparatus where the refrigerant is at the lowest temperature in the main circuit, which enables efficient cooling of the lubrication flow. Since the subcooling heat exchanger is located inside the evaporator, it may easily be configured for enhancing evaporation of the refrigerant flowing through the evaporator, by contact of the diphasic-state refrigerant of the evaporator with the subcooling heat exchanger.

Further advantageous features of the invention are defined below: The subcooling heat exchanger is configured for enabling an exchange of heat between the lubrication flow circulating through the lubrication branch and the main flow of refrigerant circulating through the evaporator outlet. The evaporator comprises: an evaporator tank, connected to the evaporator inlet so that the main flow of refrigerant is admitted within the evaporator tank; and an outlet duct, forming the evaporator outlet and connected at the top of the evaporator tank; wherein the subcooling heat exchanger is mounted within the outlet duct so that the main flow of refrigerant of the evaporator may flow along the subcooling heat exchanger when said main flow of refrigerant is discharged through the evaporator outlet; and wherein the lubrication branch comprises: an inlet duct, connecting the lubrication inlet to the subcooling heat exchanger and extending through a connection wall of the outlet duct; and an outlet duct, connecting the subcooling heat exchanger to the lubrication outlet and extending through the connection wall of the outlet duct. The connection wall is formed by a peripheral wall of the outlet duct. The outlet duct comprises a top aperture and a removable cap closing the top aperture, the removable cap comprising the connection wall through which the inlet duct and the outlet duct extend. The subcooling heat exchanger is smaller than the top aperture. The subcooling heat exchanger comprises at least one vertical straight duct extending parallel to the outlet duct, all along the outlet duct. The subcooling heat exchanger comprises at least one finned duct, each finned duct preferably being oriented horizontally and preferably comprising fin plates oriented vertically. The subcooling heat exchanger comprises at least one coil duct. The lubrication branch comprises a bypass sub-branch, extending outside from the evaporator, being connected to the lubrication inlet upstream from the subcooling heat exchanger so as to derive a bypass flow from the lubrication flow circulating through the lubrication branch, and being connected to the lubrication outlet downstream from the subcooling heat exchanger so as to feed the compressor with the by-pass flow. For being connected to the supply part, the lubrication inlet is connected to a bottom part of the condenser. The compressor is a positive displacement-type compressor. the compressor is a screw compressor comprising two meshing screw rotors and bearings, the screw-rotors being supported by the bearings; and the lubrication outlet is connected to the compressor so as to feed the bearings and the screw rotors, for lubrication of said bearings and screw rotors.

The invention also concerns a use of a refrigeration apparatus as defined above, including: closed loop circulation of the main flow of refrigerant successively through the compressor inlet, the compressor, the compressor outlet, the condenser inlet, the condenser, the condenser outlet, the valve inlet, the expansion valve, the valve outlet, the evaporator inlet, the evaporator, and the evaporator outlet; derivation of the lubrication flow from the main flow of refrigerant circulating through the supply part, by the lubrication inlet, circulation of the lubrication flow through the lubrication branch, successively through the lubrication inlet, the subcooling heat exchanger and the lubrication outlet, exchange of heat between the main flow of refrigerant circulating through the low-temperature part and the lubrication flow circulating through the lubrication branch by means of the subcooling heat exchanger, so that the lubrication flow is cooled by the main flow of refrigerant circulating through the low-temperature part, and feeding of the compressor, by the lubrication outlet, with the lubrication flow that was cooled in the subcooling heat exchanger, for lubrication of the compressor.

DRAWING DESCRIPTION

Exemplary embodiments according to the invention and including further advantageous features of the invention are explained below, referring to the attached drawings, wherein.

DETAILED DESCRIPTION

Figure 1:
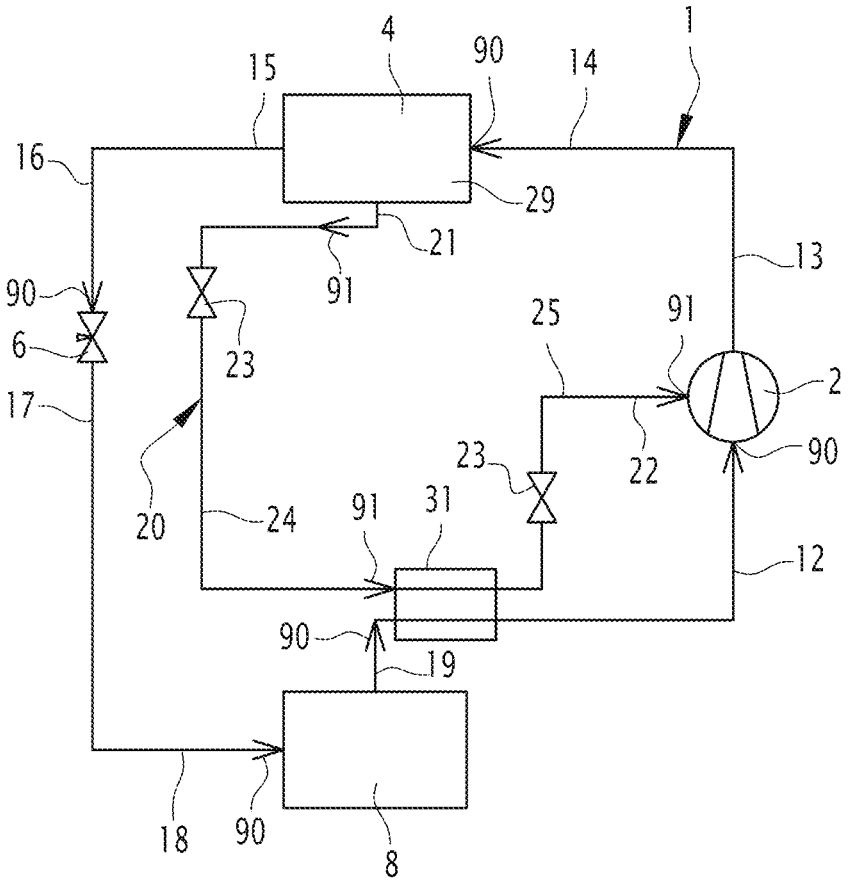
FIG. 1 is a synoptic drawing showing a first embodiment of a refrigeration apparatus according to the invention.

FIG. 1 shows a refrigeration apparatus, comprising a main circuit 1 forming a closed loop for looped circulation of a main flow 90 of refrigerant therein. During the circulation of the main flow 90 of refrigerant through the main circuit 1, the refrigerant endures a thermodynamic cycle imparted by the components of the main circuit 1.

The refrigerant of the refrigeration apparatus is a fluid material chosen to ensure both functions of refrigerant and lubricant. Preferably, the refrigerant used in the apparatus is a hydrofluoroolefin (HFO), for example R 1234ze (1,3,3,3-tetrafluoroprop-1-ene).

The main circuit 1 comprises a compressor 2, a condenser 4, an expansion valve 6 and an evaporator 8. The compressor 2 comprises a compressor inlet 12 and a compressor outlet 13. The condenser 4 includes a condenser inlet 14, connected to the compressor outlet 13, and a condenser outlet 15. The expansion valve 6 includes a valve inlet 16, connected to the condenser outlet 15 and a valve outlet 17. The evaporator 8 includes an evaporator inlet 18, connected to the valve outlet 17, and an evaporator outlet 19, connected to the compressor inlet 12.

For obtaining the thermodynamic cycle of the refrigerant, the main flow 90 of the aforementioned refrigerant is circulated through the main circuit 1 in a closed loop, successively through the compressor 2, outlet 13, inlet 14, condenser 14, outlet 15, inlet 16, expansion valve 6, outlet 17, inlet 18, evaporator 8, outlet 19, inlet 12, and through the compressor 2 again, and so on. For this purpose, the refrigerant is compressed by compressor 2. In the figures, the direction of the main flow 90 is illustrated by arrows.

Preferably, the circulation of the main flow 90 of refrigerant through the main circuit 1 is only imparted by the work of the compressor 2. However, if necessary, additional compressor or pumps may be implemented. More generally, depending on the application, the main circuit 1 may comprise additional components than the compressor 2, condenser 4, expansion valve 6 and evaporator 8, for example, an additional expansion valve, or an additional branch for deriving a portion of the main flow 90 from a part of the main circuit to another part of the main circuit, or an additional heat exchanger, that may have an economizer function.

Preferably, in a steady-state, during high load operation of the refrigerating apparatus: in the compressor 2, the refrigerant is in a gaseous state, and is compressed from a low pressure to a high pressure, which raises the temperature of the refrigerant from a low temperature to a high temperature; in the outlet 13 and in the inlet 14, the refrigerant is in a gaseous state, or essentially gaseous state, is at the high temperature and the high pressure; in the condenser 4, the refrigerant is in a diphasic state, including gaseous and liquid refrigerant, and is condensed to a liquid state by the condenser 4; in the outlet 15 and in the inlet 16, the refrigerant is in a liquid state, or essentially liquid state, is at the high pressure, and may be at the high temperature or at a temperature between the high temperature and the low temperature; in the expansion valve 6, the refrigerant is brought to the low pressure, which lowers the temperature of the refrigerant to the low temperature while evaporating the refrigerant to the diphasic state; in the outlet 17 and in the inlet 18, the refrigerant is in a diphasic-state, where a major part is liquid and a smaller part is gaseous, and the refrigerant is at the low temperature and the low pressure; in the evaporator 8, the refrigerant is in a diphasic state, including gaseous and liquid refrigerant, and is evaporated to a gaseous state by the evaporator 8; in the outlet 19 and in the inlet 12, the refrigerant is in a gaseous state, or essentially gaseous state, at the low pressure and at a low temperature, or at a temperature between the low and the high temperature.

For example, the low temperature is approximately between 5-10° C., the high temperature is approximately between 35-40° C., the low pressure is approximately between 3-4 bar, and the high pressure is approximately between 6-10 bar.

Considering the above, the main circuit 1 comprises a high-pressure part, comprising the compressor outlet 13, the condenser 4 and the valve inlet 16, and a low pressure part, comprising the valve outlet 17, the evaporator 8 and the compressor inlet 12.

The main circuit 1 comprises a so-called "supply part", which covers only a portion of the high pressure part, where the refrigerant is mostly in liquid state and high pressure, the supply part preferably consisting in the condenser 4, the valve inlet 16, and any part of the main circuit 1 between the condenser outlet 15 and the valve inlet 16, i.e. downstream from the outlet 15 and upstream from the inlet 16. The supply part advantageously constitutes a part of the circuit 1 where the refrigerant of the flow 90 is in the most appropriate state to be used as lubricant.

The main circuit 1 comprises a so-called "low-temperature part", which covers only a portion of the low pressure part, where the refrigerant is at, or mostly at, the low temperature and low pressure, the low-temperature part preferably consisting in the evaporator 8, the compressor inlet 12, and any part of the circuit 1 between the evaporator outlet 19 and the compressor inlet 12, i.e. downstream from the outlet 19 and upstream from the inlet 12. In the low-temperature part, the refrigerant of the flow 90 is advantageously at its coldest temperature.

Preferably, the compressor 2 is a positive displacement-type compressor, also called volumetric compressor, such as piston compressor, scroll compressor, roots compressor or screw compressor. More preferably, the compressor 2 is a screw compressor, comprising two parallel meshing screw rotors, for imparting compression to the refrigerant. The screw rotors are supported in rotation relative to a frame of the compressor 2 by at least four bearings of the compressor 2, each of the screw rotors being individually supported by two of the four bearings. The compressor 2 is equipped with a motor, driving one of the screw rotors in rotation, the second screw rotor being also driven in rotation by meshing with the first screw rotor.

The compressor 2 is configured to be lubricated by the refrigerant, and not by a separate lubricant. Thus, the compressor 2 may be qualified of "oil-free compressor". Preferably, the entire refrigeration apparatus is oil-free.

Preferably, the condenser 4 comprises or constitutes a heat exchanger, able to exchange heat between the refrigerant of the main circuit 1 and water, ambient air, or any other suitable medium able to absorb heat from the main flow 90 of refrigerant circulating through the condenser 4.

Preferably, the evaporator 8 comprises or constitutes a heat exchanger, able to exchange heat between the refrigerant of the main circuit 1 and a thermal charge to be cooled by the refrigerant. The thermal charge may comprise water, or any other substrate to be cooled by the refrigeration apparatus.

The refrigeration apparatus comprises a lubrication branch 20 distinct from the main circuit 1, and connected to the main circuit 1. The lubrication branch 20 is a passage for a flow 91 of refrigerant originating from the main flow 90 of refrigerant of the main circuit 1. The flow 91 is designated as "lubrication flow". The lubrication flow 91 is a flow of refrigerant, formed by a portion of the main flow 90.

The branch 20 comprises an inlet 21, designated as "lubrication inlet" and an outlet 22, designated as "lubrication outlet". The inlet 21 is connected to the main circuit 1 at a bottom part 29 of the condenser 4, which belongs to the supply part of the main circuit 1. Alternatively, the inlet 21 could be connected for example between the condenser 4 and the expansion valve 6, preferably at the condenser outlet 15. Alternatively, for connection of the inlet 21, any portion of the supply part of the main circuit 1 may be chosen, since, in the supply part of the main circuit 1, at least a part of the refrigerant is in liquid phase.

Preferably, the inlet 21 derives the flow 91 from the main flow 90 of refrigerant that has already circulated through the condenser inlet 14, that has already exchanged heat with the ambient water, ambient air or similar medium through the condenser 4, and that has not yet circulated through the condenser outlet 15. More preferably, the inlet 21 derives the flow 91 at the bottom part 29 of the condenser 4 where liquid-state refrigerant from the flow 90 is received by gravity.

In a preferred alternative, the inlet 21 derives the flow 91 from the main flow 90 that circulates through the condenser outlet 15, where there is a good chance that most or all of the refrigerant of the flow 90 is in a liquid form.

Alternatively, several lubrication inlets 21 may be provided, for deriving refrigerant from the main flow 90 at multiple locations of the supply part.

The flow 91 is introduced into the branch 20 by the inlet 21. The outlet 22 is connected to the compressor 2, for feeding the compressor 2 with the flow 91, for lubrication of said compressor 2 by means of the flow 91. The outlet 22 is connected at inlets of the compressor 2 that differ from the inlet 12, for feeding mechanical parts of the compressor 2 that require lubrication. Preferably, the outlet 22 is connected to inlets of the compressor 2 that feed the bearings and/or the compression cavities formed by the screw rotors, so that they are lubricated by the liquid refrigerant fed by the branch 20.

Optionally, the branch 20 comprises one or more valves 23, such as solenoid valves and/or throttle valves, for adjusting the flow rate of the flow 91 admitted within the branch 20 and introduced into the compressor 2.

As explained above, during high load operation of the apparatus, the flow 91 of refrigerant derived at the inlet 21 is usually liquid. However, during a lower load operation of the apparatus, the refrigerant of the flow 91 may be diphasic at the inlet 21. For ensuring that, when reaching the compressor 2, the refrigerant of the flow 91 is in liquid form, or is in diphasic form with sufficient proportion of liquid refrigerant, the branch 20 comprises a subcooling heat exchanger 31, for cooling the refrigerant of the flow 91 upstream from the lubrication outlet 22.

Figure 2:
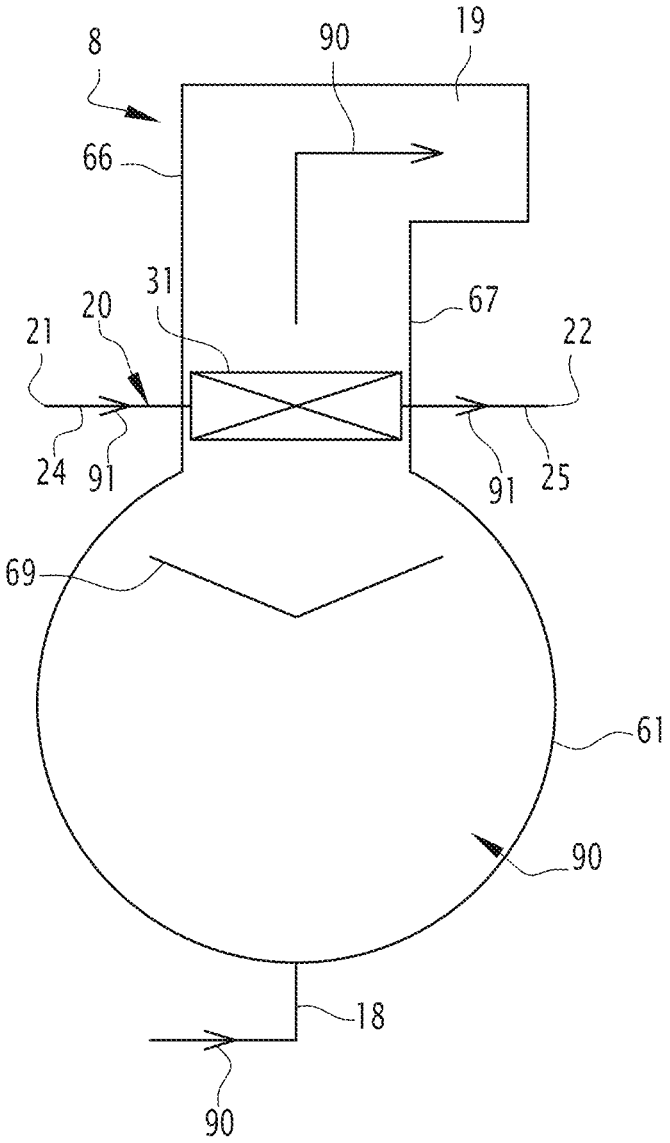
FIG. 2 is a synoptic drawing showing only a part of the refrigeration apparatus of FIG. 1.

As shown in FIGS. 1 and 2, the subcooling heat exchanger 31 is positioned entirely inside the evaporator 8, in particular inside the evaporator outlet 19. During operation, the heat exchanger 31 is surrounded by the refrigerant of the main flow 90 circulating through the evaporator 8. Thus, the heat exchanger 31 is configured for enabling or promoting an exchange of heat between the lubrication flow 91 and the main flow 90 of refrigerant, so that the refrigerant of the lubrication flow 91 is sub-cooled by exchange of heat with the main flow 90 circulating through the evaporator 8. The lubrication flow 91 and the main flow 90 of the evaporator 8 are not brought into contact or mixed together. Instead, they are circulated close to each other with separation by a thin heat-conductive wall of the heat exchanger 31, promoting heat exchange between them. Thus, within the exchanger 31, the lubrication flow 91 is cooled by the main flow 90, and the main flow 90 is heated by the lubrication flow 91.

Since the refrigerant of the lubrication flow 91 is cooled in the subcooling heat exchanger 31, the apparatus ensures that the refrigerant of the lubrication flow 91 is in a liquid state, or has a high proportion of liquid refrigerant, when entering the compressor 2 at the outlet 22. Even when the apparatus operates at low load, i.e. low flow rate of the main flow 90, appropriate lubrication of the compressor 2 is ensured.

Preferably, as shown in FIG. 2, the evaporator 8 is a flooded heat exchanger. As shown in FIG. 2, the evaporator 8 advantageously comprises a tank 61, here designated as "evaporator tank", receiving the refrigerant of the main flow 90 of the main circuit 1. The evaporator 8 also comprises heat exchange passages, crossing through the tank 61 so as to be surrounded with the refrigerant of the main circuit 1 received within the tank 61. These heat exchange passages are not shown on the figures. Preferably, these heat exchange passages are ducts, so that the evaporator 8 is a flooded tube heat exchanger. Water or any other thermal charge may circulate through these passages so as to be cooled by the refrigerant contained in the tank 61.

Preferably, the tank 61 is of generally cylindrical shape, as this is the case in FIG. 2.

The bottom of the tank 61 is connected to the evaporator inlet 18. Thus, the main flow 90 of refrigerant coming from the expansion valve 6 is admitted in the evaporator 8 at the bottom of the tank 61.

The evaporator 8 comprises an outlet duct 66, connected at the top of the tank 61. In the illustrated embodiment, the duct 66 forms, i.e. constitutes, the evaporator outlet 19. The duct 66 comprises a peripheral wall 67 preferably shaped as a vertical duct for guiding the main flow 90 upwards. The lower end of the duct 66, in particular of the peripheral wall 67, is connected to the top of the tank 61. Thus, the refrigerant received within the tank 61 is discharged through the duct 66 for reaching the compressor 2 at the inlet 12. The duct 66 may be designated as "suction duct".

As shown in FIG. 2, the heat exchanger 31 is advantageously mounted within the duct 66, preferably at a lower end of said duct 66, within the peripheral wall 67.

Optionally, the evaporator 8 may comprise a baffle 69, positioned in the evaporator tank 61, below the duct 66 and below the subcooling heat exchanger 31. The baffle 69 is a diverter plate, for example shaped as an upside-down roof, for preventing accidental admission of liquid refrigerant droplets into the duct 66. Such droplets may be accidentally projected upwards due to the evaporation process, which may include boiling, or high flow rate, of the flow 90 circulating through the tank 61.

As shown in FIG. 2, the heat exchanger 31 may entirely be contained in the duct 66. Alternatively, the heat exchanger 31 may partially or completely be positioned in the upper half of the tank 61. Preferably, the heat exchanger is entirely positioned over the baffle 69.

In the tank 61, the refrigerant is received in a diphasic state. During operation, the liquid refrigerant sits at the bottom of the tank 61, the evaporated gaseous refrigerant being positioned at the top of the tank 61. The level of liquid, separating liquid refrigerant from gaseous refrigerant in the tank 61, is located between the top and the bottom of the tank 61, crossing the tank 61 transversally.

During operation, the evaporated refrigerant of the main flow 90, received within the tank 61, flows up into the duct 66, where said refrigerant flows along or through the heat exchanger 31. Then the refrigerant reaches the compressor inlet 12. Thus, the heat exchanger 31 is surrounded by gaseous, or essentially gaseous, refrigerant of the main flow 90.

As shown in FIGS. 1 and 2, the lubrication branch 20 preferably comprises an inlet duct 24, connecting the lubrication inlet 21 to the heat exchanger 31. The inlet duct 24 passes through the peripheral wall 67 of the duct 66 for reaching the heat exchanger 31 inside. Thus, the wall 67 is designated as "connection wall" of the heat exchanger 31. The branch 20 also comprises an outlet duct 25, connecting the exchanger 31 to the outlet 22. The outlet duct 25 also passes through the peripheral wall 67, preferably at diametrically opposed side than the duct 24, for reaching the exchanger 31 housed within the duct 66.

During operation, droplets of unevaporated refrigerant contained in the main flow 90 passing through the duct 66 may advantageously be evaporated or stopped by the exchanger 31, since the lubrication flow 91 of refrigerant contained in the exchanger 31 is at a higher temperature than the main flow 90 of refrigerant in the duct. Consequently, the need for the baffle 69 is reduced, which may enable designing an evaporator with reduced pressure drop.

More generally, instead of being received within the outlet duct 66, the subcooling heat exchanger 31 may be positioned anywhere where it may enable an exchange of heat between the lubrication flow 91 circulating through the lubrication branch 20 before said flow reaches the outlet 22, and between the main flow 90 circulating through the low-temperature part of the main circuit 1. For example, the heat exchanger 31 may be positioned within the tank 61, or at the compressor inlet 12. The heat exchange 31 may be external from the tank 61, outlet 19 and inlet 12, and may, for example, surround the outlet duct 66.

Alternatively, several lubrication heat exchangers 31 may be provided, for exchanging heat between the flows 90 and 91 at multiple locations of the low-temperature part of the circuit 1.

Figure 3:
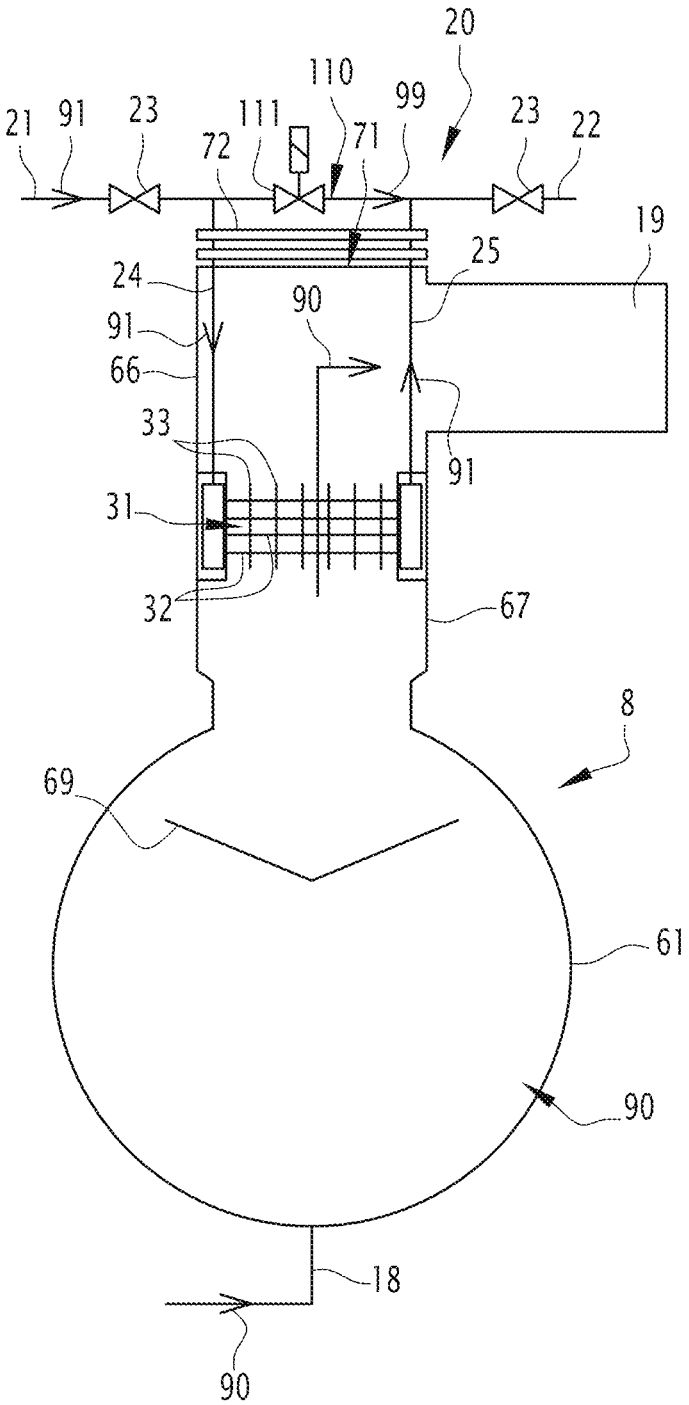
FIG. 3 is a synoptic drawing similar to FIG. 2, showing only a part of a second embodiment of a refrigeration apparatus according to the invention.

The embodiment of FIG. 3 concerns a refrigeration apparatus identical to the apparatus of the embodiment of FIGS. 1 and 2, although the branch 20, the heat exchanger 31 and duct 66 are modified.

In the embodiment of FIG. 3, the duct 66 comprises a top end at the end of the peripheral wall 67. A further part of the duct 66 is connected radially to the peripheral wall. The duct 66 comprises a top aperture 71 for accessing inside said duct 66 from the outside, for maintenance purpose or the like. The evaporator 8 comprises a removable cap 72, which is removably secured to the aperture 71 for tightly closing the aperture 71. The cap 72 may be removed for accessing inside the duct 66 through the aperture 71.

Optionally, as depicted in FIG. 3, the inlet duct 24 and the outlet duct 25 of the branch 20 both pass through the removable cap 72. Thus, in this case, the cap 72 constitutes the connection wall of the duct 66. Preferably, the respective part of the ducts 24 and 25 that is inside the duct extends parallel to the duct 66, i.e. vertically. Preferably, these respective parts of the ducts 24 and 25 extend along the wall 67, at diametrically opposite locations, as shown in FIG. 3.

In a preferred embodiment, the heat exchanger 31 is suspended, or at least secured, to the cap 72 by means of the ducts 24 and 25, so that when the cap 72 is removed, the heat exchanger 31 remains attached to the cap 72. Thus, maintenance of the exchanger 31 is made easier since removing the cap 72 and the exchanger 31 from the duct 66 is obtained in a single step.

Preferably, for the heat exchanger 31 to be inserted or removed through the aperture 71, the heat exchanger 31 is smaller in size than the aperture 71, or at least of corresponding shape. This may be implemented even if the heat exchanger 31 is not attached to the cap 72 as explained above. Inserting and removing the heat exchanger 31 through the top aperture 71 may be convenient since maintenance of the heat exchanger 31 does not require dismounting the entire evaporator 8.

As shown in FIG. 3, the heat exchanger 31 comprises several finned ducts 32, each finned duct connecting the duct 24 to the duct 25. Thus, each finned duct 32 derives a respective flow of refrigerant, which is a portion from the lubrication flow 91 discharged by the duct 24, and discharges said respective flow into the duct 25. For this purpose, the finned ducts 32 are connected to the duct 24 by means of an inlet manifold and to the duct 25 by an outlet manifold, positioned diametrically opposite of the duct 66. Each finned duct 32 promotes heat exchange between the refrigerant circulating through the finned duct 32 and the refrigerant circulating through the duct 66, around said finned duct 32. Each finned duct 32 preferably extends transversally, i.e. horizontally, within the duct, from one side of the wall 67 to the other. The finned ducts 32 are advantageously parallel to each other. The finned duct 32 comprises several fin plates 33. For example, each fin plate 33 is formed by a tubesheet, linking the ducts 32 together. The fin plates 33 are preferably oriented parallel to the duct 66, i.e. parallel to a vertical plane, and perpendicular to the ducts 32. Preferably, the fin plates 33 are regularly spaced along the concerned duct 32.

The finned ducts 32 and the fin plates 33 enhance vaporization of any leftover droplets that may be contained in the lubricant of the main flow 90 discharged through the duct 66, acting both as a filter and as a radiator.

Optionally, as shown in FIG. 3, the lubrication branch 20 comprises a bypass sub-branch 110, extending entirely outside of the evaporator 8. The sub-branch 110 connects the inlet 21 to the outlet 22, outside of the evaporator 8. Thus, a flow 99, designated as "bypass flow", is derived from the lubrication flow 91 through the sub-branch 110, without passing through the exchanger 31. In other words, the bypass flow 99 circulates from the condenser 4 to the compressor 2, without passing through the valve 6, the evaporator 8 or the exchanger 31. Thus, the heat exchanger 31 is bypassed by the sub-branch 110. More precisely, the sub-branch 110 is connected to the inlet 21, upstream from the heat exchanger 31 and to the outlet 22, downstream from the heat exchanger 31. The branch 110 may be equipped with a valve 111 or a throttle valve for interrupting the circulation of the sub-potion 99, or for adjusting the flow rate of the bypass flow 99 circulating through the branch 110.

Figure 4:
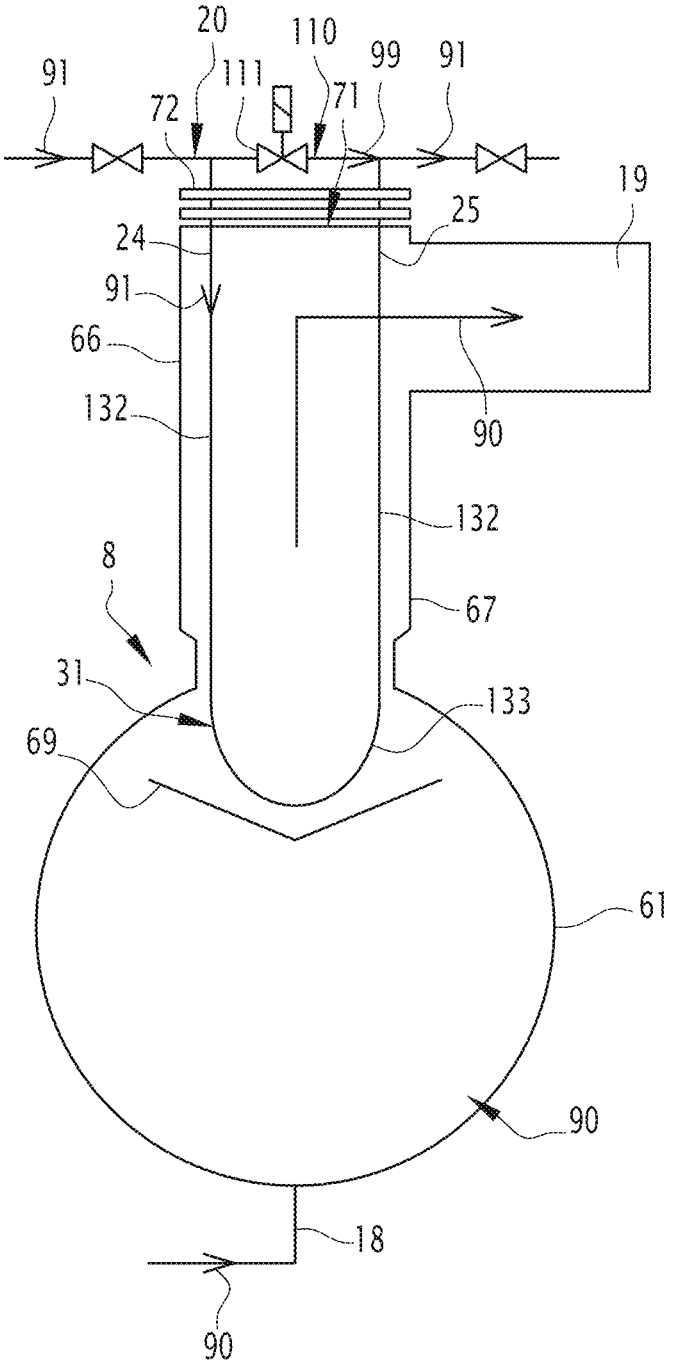
FIG. 4 is a synoptic drawing similar to FIG. 2, showing only a part of a third embodiment of a refrigeration apparatus according to the invention.

The embodiment of FIG. 4 concerns a refrigeration apparatus identical to the apparatus of the embodiment of FIG. 3, although the heat exchanger 31 is modified.

In the embodiment of FIG. 4, the heat exchanger 31 comprises a pair of vertical straight ducts 132, extending inside the duct 66, along the wall 67. Each straight duct extends all along the duct 66, namely from the upper end to the lower end of said duct 66. The straight ducts 132 are connected respectively to the inlet duct 24 and to the outlet duct 25. The heat exchanger 31 further comprises a U-shaped duct 133, positioned at the lower end of the duct 66 or at the top of the tank 61, over the baffle 69, and connecting the ducts 132 together. Thus, the lubrication flow 91 circulates from the inlet duct 24, down through the first straight duct 132, through the U-Shaped duct 133, up through the second straight duct 132, to the outlet duct 25. The simple U-shape of this heat exchanger 31 enables easier and less expansive manufacturing thereof.

The two straight ducts 132 and the U-shaped duct 133 together constitute a heat exchange assembly. In the example of FIG. 4, the heat exchanger 31 comprises only one heat exchange assembly. Alternatively, the heat exchanger 31 may comprise several heat exchange assemblies mounted in parallel within the duct 66 and over the baffle 69, all the heat exchange assemblies being connected to the duct 24 by means of an inlet manifold, and to the duct 25 by means of an outlet manifold.

In a non-shown embodiment, the subcooling heat exchanger comprises a coil duct, or several coil ducts, each coil duct being positioned within the duct 66. Each coil duct connects the duct 24 to the duct 25.

In a non-shown alternative embodiment, the subcooling heat exchanger comprises a plate fin heat exchanger, for which the fins are preferably parallel to the duct 66.

Each feature disclosed for an embodiment disclosed above may be implemented in any other embodiment disclosed above, as long as technically feasible.

What is claimed is:

1. A refrigeration apparatus, comprising a main circuit, including:

a compressor, including a compressor inlet and a compressor outlet, a condenser, including a condenser inlet, connected to the compressor outlet, and a condenser outlet, an expansion valve, including a valve inlet, connected to the condenser outlet and a valve outlet, and an evaporator, including an evaporator inlet, connected to the valve outlet, and an evaporator outlet, connected to the compressor inlet, wherein the main circuit is configured for a loop circulation of a main flow of refrigerant, successively through the compressor, the condenser, the expansion valve, and the evaporator, wherein the refrigeration apparatus further comprises a lubrication branch, comprising:

a lubrication inlet, connected to a supply part of the main circuit, the supply part consisting of the condenser, the valve inlet, and any part of the main circuit between the condenser outlet and the valve inlet, the lubrication inlet being configured to derive a lubrication flow from the main flow of refrigerant circulating through the supply part; and a lubrication outlet, connected to the compressor so as to feed the compressor with the lubrication flow, for lubrication of said compressor with the refrigerant of the lubrication flow, wherein the main circuit comprises a low-temperature part, consisting of the evaporator, the compressor inlet, and any part of the main circuit between the evaporator outlet and the compressor inlet, wherein the lubrication branch further comprises a subcooling heat exchanger, which is configured for enabling an exchange of heat between the lubrication flow circulating through the lubrication branch and the main flow of refrigerant circulating through the low-temperature part, so that the lubrication flow may be cooled by the main flow of refrigerant circulating through the low-temperature part, within the subcooling heat exchanger;

wherein the evaporator comprises:

an evaporator tank, connected to the evaporator inlet so that the main flow of refrigerant is admitted within the evaporator tank; and an outlet duct, forming the evaporator outlet and connected at the top of the evaporator tank;

wherein the subcooling heat exchanger is mounted within the outlet duct so that the main flow of refrigerant of the evaporator may flow along the subcooling heat exchanger when said main flow of refrigerant is discharged through the evaporator outlet; and wherein the lubrication branch comprises:

an inlet connecting the lubrication inlet to the subcooling heat exchanger and extending through a connection wall of the outlet duct, and an outlet connecting the subcooling heat exchanger to the lubrication outlet and extending through the connection wall of the outlet duct.

2. The refrigeration apparatus according to claim 1, wherein the subcooling heat exchanger is configured for enabling an exchange of heat between the lubrication flow circulating through the lubrication branch and the main flow of refrigerant circulating through the evaporator outlet.

3. The refrigeration apparatus according to claim 1, wherein the connection wall is formed by a peripheral wall of the outlet duct.

4. The refrigeration apparatus according to claim 1, wherein the outlet duct comprises a top aperture and a removable cap closing the top aperture, the removable cap comprising the connection wall through which the inlet and the outlet extend.

5. The refrigeration apparatus according to claim 4, wherein the subcooling heat exchanger is smaller than the top aperture.

6. The refrigeration apparatus according to claim 1, wherein the subcooling heat exchanger comprises at least one vertical straight duct extending parallel to the outlet duct, all along the outlet duct.

7. The refrigeration apparatus according to claim 1, wherein the subcooling heat exchanger comprises at least one finned duct.

8. The refrigeration apparatus according to claim 7, wherein each finned duct is oriented horizontally and comprises fin plates oriented vertically.

9. The refrigeration apparatus according to claim 1, wherein the subcooling heat exchanger comprises at least one coil duct.

10. The refrigeration apparatus according to claim 1, wherein the lubrication branch comprises a bypass sub-branch, extending outside from the evaporator, being connected to the lubrication inlet upstream from the subcooling heat exchanger so as to derive a bypass flow from the lubrication flow circulating through the lubrication branch, and being connected to the lubrication outlet downstream from the subcooling heat exchanger so as to feed the compressor with the by-pass flow, wherein the bypass sub-branch includes a valve positioned between an inlet and an outlet of the subcooling heat exchanger.

11. The refrigeration apparatus according to claim 1, wherein, for being connected to the supply part, the lubrication inlet is connected to a bottom part of the condenser.

12. The refrigeration apparatus according to claim 1, wherein the compressor is a positive displacement-type compressor.

13. The refrigeration apparatus according to claim 1, wherein:

the compressor is a screw compressor comprising two meshing screw rotors and bearings, the screw-rotors being supported by the bearings, and the lubrication outlet is connected to the compressor so as to feed the bearings and the screw rotors, for lubrication of said bearings and screw rotors.

14. A use of a refrigeration apparatus according to claim 1, including:

closed loop circulation of the main flow of refrigerant successively through the compressor inlet, the compressor, the compressor outlet, the condenser inlet, the condenser, the condenser outlet, the valve inlet, the expansion valve, the valve outlet, the evaporator inlet, the evaporator, and the evaporator outlet;

derivation of the lubrication flow from the main flow of refrigerant circulating through the supply part, by the lubrication inlet, circulation of the lubrication flow through the lubrication branch, successively through the lubrication inlet, the subcooling heat exchanger and the lubrication outlet, exchange of heat between the main flow of refrigerant circulating through the low-temperature part and the lubrication flow circulating through the lubrication branch by means of the subcooling heat exchanger, so that the lubrication flow is cooled by the main flow of refrigerant circulating through the low-temperature part, and feeding of the compressor, by the lubrication outlet, with the lubrication flow that was cooled in the subcooling heat exchanger, for lubrication of the compressor.

* * * * *